US005121591A

United States Patent [19]

Backus et al.

[11] Patent Number: 5,121,591

[45] Date of Patent: Jun. 16, 1992

[54] PACKING DEVICE FOR CUT PRODUCTS

[75] Inventors: Steven M. M. Backus, Velden, Netherlands; Paul J. McKee, Holland, Mich.

[73] Assignee: Backus Beheer B.V., Venlo, Netherlands

[21] Appl. No.: 674,853

[22] Filed: Mar. 26, 1991

[30] Foreign Application Priority Data

Mar. 26, 1990 [NL] Netherlands ..... 9000707

[51] Int. Cl.[5] ..... B65B 63/00

[52] U.S. Cl. ..... 53/515; 53/258; 53/263

[58] Field of Search ..... 99/537; 83/161, 425, 83/431, 437; 53/145, 146, 147, 252, 258, 263, 435, 446, 514, 515, 544

[56] References Cited

U.S. PATENT DOCUMENTS

| | | | |
|---|---|---|---|
| 797,751 | 8/1905 | Roth | 53/263 X |
| 1,599,041 | 9/1926 | Davis | 53/263 |
| 2,261,423 | 11/1941 | Toulouse | 53/263 X |
| 3,461,646 | 8/1969 | Lane et al. | 53/515 |
| 3,468,098 | 9/1969 | Eisenberg | 53/515 |
| 3,662,518 | 5/1972 | Eisenberg | 53/515 |
| 4,453,368 | 6/1984 | Egee | 53/515 X |
| 4,537,017 | 8/1985 | Hengstenberg et al. | 53/515 |
| 4,539,879 | 9/1985 | Egee | 53/515 X |
| 4,646,509 | 3/1987 | Tribert . | |

*Primary Examiner*—Robert L. Spruill
*Assistant Examiner*—Daniel B. Moon
*Attorney, Agent, or Firm*—Wegner, Cantor, Mueller & Player

[57] ABSTRACT

A packing device for cut products is used for packing a number of products such as pickles, cucumbers, and the like into a cylindrical holder such as a glass jar. The device includes at least one cutting member for cutting each product into portions, a member for receiving the portions, a member for transporting the holders, and a member for guiding the portions into the holders in a predetermined pattern. The guiding member includes a number of prism-shaped carriers disposed in a circle so that each receives a portion, wherein each carrier is pivotable about an axis from a first position to a second position. Pivoting of the carriers allows for guiding of the portions into the holders according to the predetermined pattern.

5 Claims, 10 Drawing Sheets

PACKING DEVICE FOR CUT PRODUCTS

BACKGROUND OF THE INVENTION

The invention relates to a device for packing a number of products such as pickles, cucumbers and the like into a cylindrical holder such as a glass jar, which device substantially comprises:

at least one cutting member for cutting each product into portions, a means receiving the portions, means for transporting the or each holder, and means co-acting therewith for guiding and filling the portions into the holder in a pre-determined pattern.

A known device of the type described in the preamble makes use of rather long transporting paths to bring the cut portions of each product into the correct spatial position in order to be able to place these in the pot according to the determined pattern. This requires quite a lot of space, in addition to long transporting times and therefore long cycle durations for filling the holders.

SUMMARY OF THE INVENTION

The invention has for its object to provide a device wherein the above mentioned problems are solved.

The device according to the invention is distinguished in that the receiving member consists of a number of carriers in the form of a prism placed in a circle and each receiving a portion, each of which is pivotable about an axis from a first position, wherein the portion coming out of the cutting member is received, to a second position wherein the portion is delivered to the filling, guiding means.

The axis of a carrier preferably runs parallel to and close to a rib thereof, which axes are disposed in the form of a circle.

With the above mentioned carriers it is possible in a very restricted space to carry the cut portion of the product from the position as they emerge from the cutting member to the desired position for packing in the holder.

This position is preferably such that a cut surface of the product portion comes to lie against the wall of the holder so that in the case of a glass jar the product is readily viewable by the user thereof.

According to a further development of the invention the filling, guiding means consist of a number of prismatic passages corresponding with the number of carriers and likewise disposed in a circle, wherein a displaceable guiding member is arranged in the passages.

Above mentioned and other features will be further elucidated in the figure description hereinafter of an embodiment of the device according to the invention.

DETAILED DESCRIPTION

Figure 1:
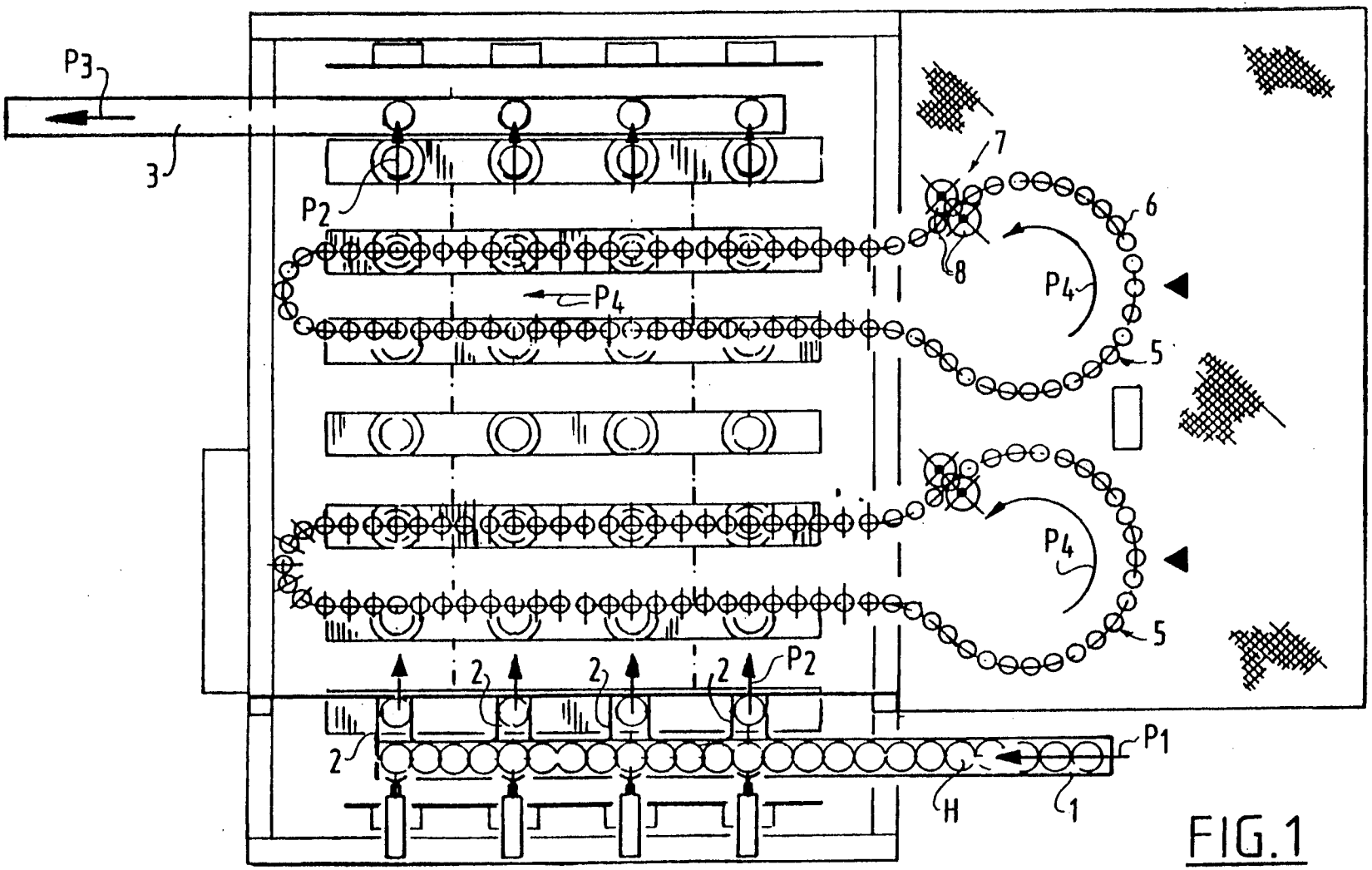
FIG. 1 shows a schematic top view of a device for packing into holders products to be cut into portions.

In the figures the same components are designated with the same reference numerals.

The device shown in the figures consists substantially of a feed conveyor line for holders, in particular glass jars, H, which feed line 1 supplies a number of transverse conveyor lines 2 for the holders H. These transverse conveyors 2 lead to a discharge conveyor 3 for the filled holders, which is further elucidated hereinafter. The conveying direction of the holders is indicated with the arrows P1, P2 and P3. Arranged at a higher level than the conveying level for the holders H are two endless conveyors 5 in which the products for packing are picked up one by one and moved in the direction of the arrow P4. In the uppermost drawn part of the endless conveyor 5 in FIG. 1 the products are processed and fed through downward into the holders H. It is noted here that in the placing of the products, for instance pickles, cucumbers etc., into cylindrical product receivers 6 wherefrom the chain of the endless conveyor 5 is formed, products can protrude above these product receivers 6. To this end the receivers 6 run through beneath a cutting station 7 consisting of two circular knife discs 8 which are located in a level at the top of the product receivers 6. During through-feed of the product receivers 6 the excess portion at the top is cut off by these knife discs 8. In this way the product is brought to a length suitable for packing in the holder H.

There now follows a description of the processing stations for processing the products V and the subsequent filling of the holders H.

Figure 2:
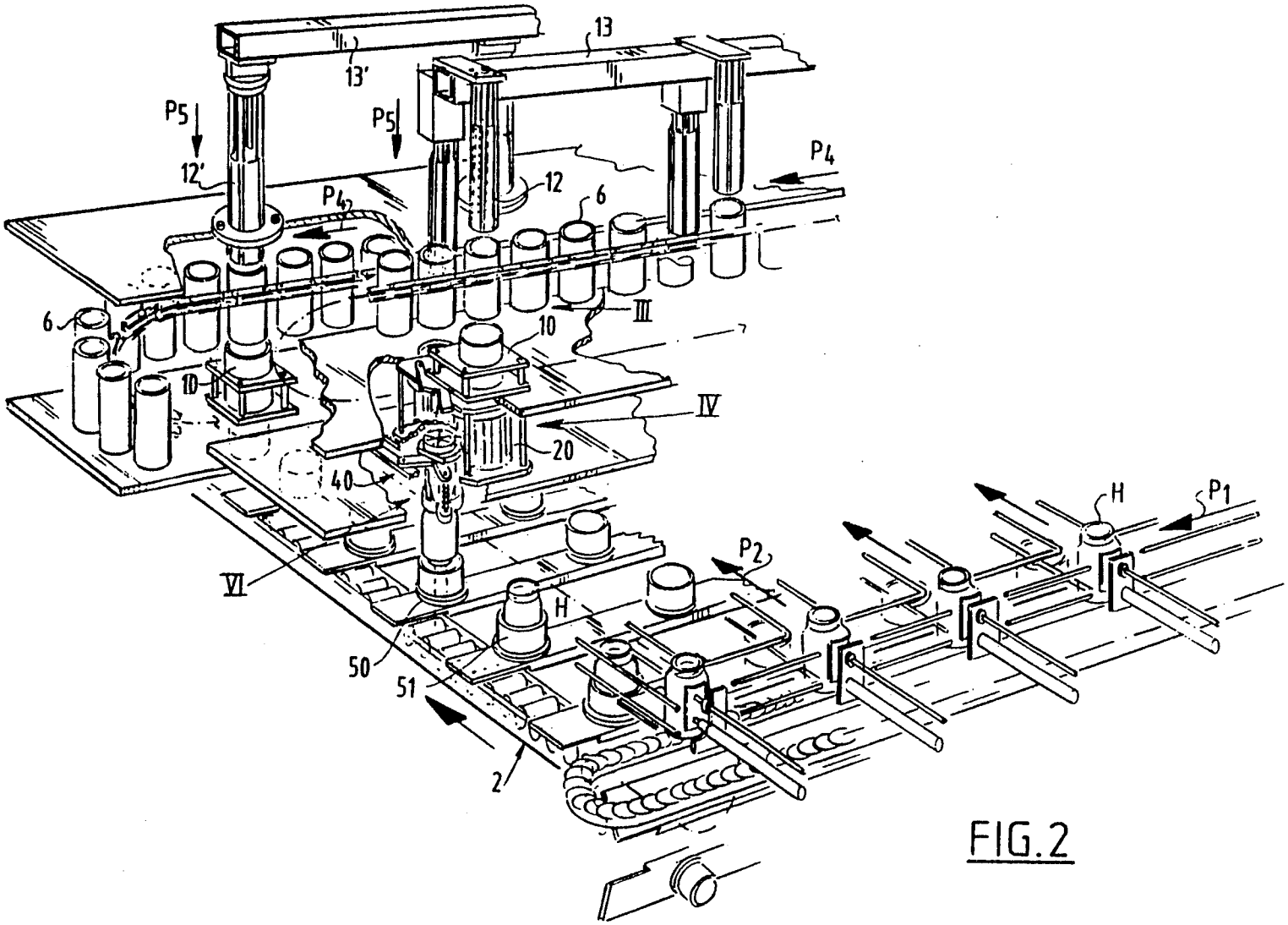
FIG. 2 is a perspective view of a part of the device of FIG. 1.
Figure 3:
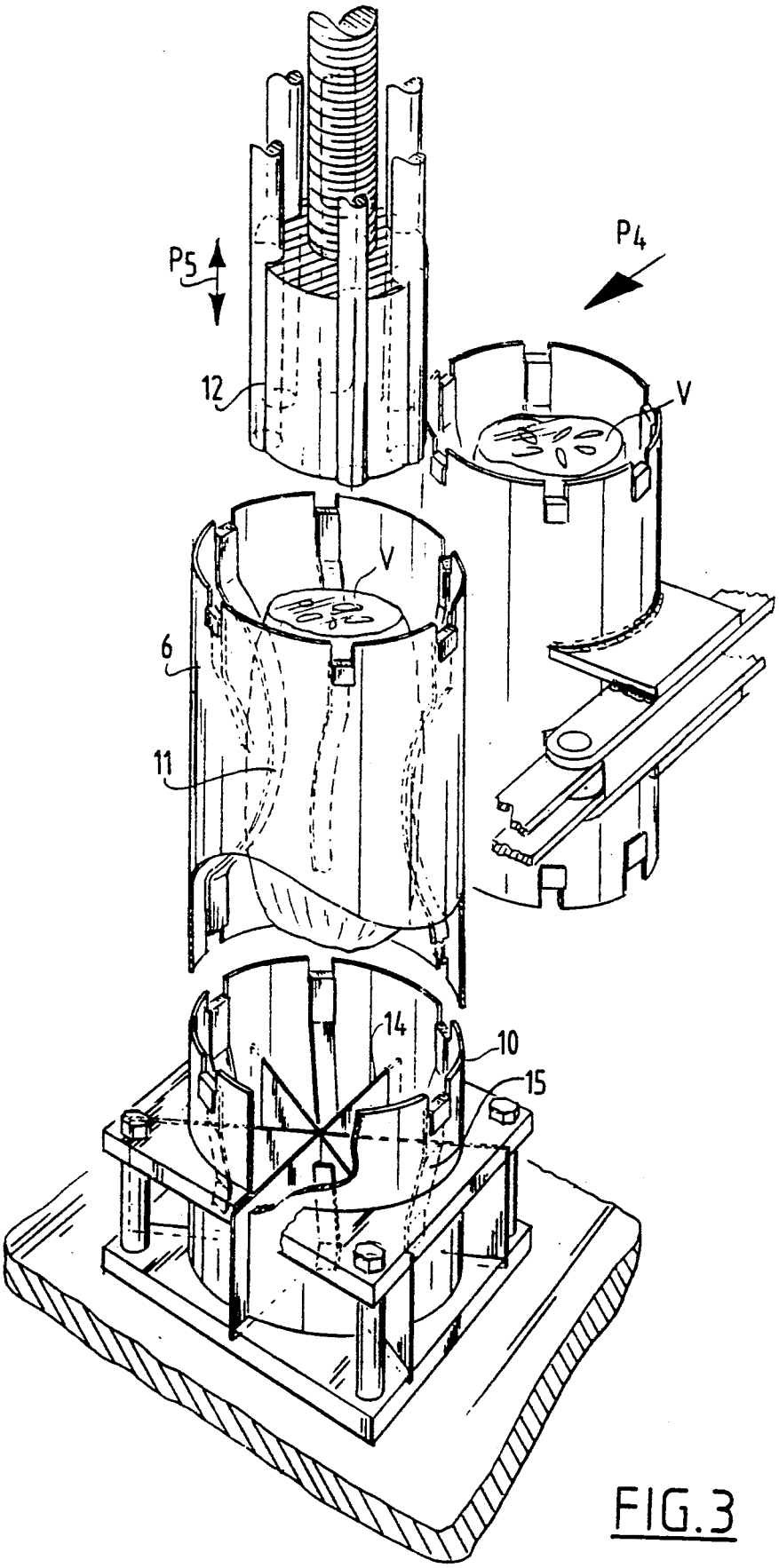
FIG. 3 shows a standing perspective view of a detail of the device of FIG. 2 along arrow III.

In FIG. 2 and 3 can be seen how the product V in the cylindrical receiver is fed according to arrow P4 to above a cutting station 10, see FIG. 3. It is remarked here that the receiver 6 is cylindrical and open at both the top and bottom. The product V is held fixedly by clamping springs 11 arranged in the receiver 6, six of which are distributed evenly over the periphery of the receiver 6. It will be apparent that holding in place of the object V can take place in ways other than with the clamping springs 11.

Arranged above the cutting station 10 is a pressure element 12 that is up and downwardly movable according to the arrow P5. Forming part of each conveyor belt 2 for the holders H is a pressure element 12 which are fixed collectively onto an up and downwardly movable beam 13. The up and downward movement of the beam 13 can be performed in random manner and is not further explained.

The cutting station 10 likewise has a cylindrical form similar to the receiver 6 except that within the cylindrical wall 13 are arranged a number of fixed cutter plates 14. In the embodiment as shown in FIG. 3 three continuous plates 14 are arranged so that six knives are formed which divide the cylinder into six compartments. It will be apparent from the above that when the pressure element 12 moves downward through the cylindrical holder 6 the object V is pressed downward and along the cutter plates 14 so that the product is divided into six longitudinal portions.

It is further noted here that each compartment between the cutter plates 14 is once again provided with pressure spring strips 15 which ensure that the product V is pressed precisely in the middle onto the cutter plates 14, whereby six equal longitudinal portions are obtained.

Now follows the description of the orienting of the obtained longitudinal portions of the product V into the filling position for a holder. This orienting station is designated with 20 in FIG. 2 and shown in detail in FIG. 4.

The orienting means shown in the orienting station 20 form the main characteristic of the present invention. These orienting means consist of a number of carriers 21 in the form of a prism which display in top view a substantially triangular shape. Each prismatic carrier 21 is provided at the top and bottom of a standing lengthwise rib with a journal 22, which journals are mounted rotatably in a top and bottom support plate 23. Arranged at the top point of rotation 22' is a gear wheel 24 that co-acts with the toothing on the inside of a gear wheel rim 25. This gear wheel rim 25 is arranged rotatably in a recess of an annular support element 26 that is fixedly attached to the top support plate 23. The gear wheel rim 25 is also provided with an outer rim which is in engagement with a pinion 27 that is fixedly attached to an element 28 (not further shown) forming part of the main frame of the device. This is to be considered a fixed point so that the pinion 27 is not rotatable relative thereto and therefore itself forms a fixed point. The toothed pinion is in addition provided with a cylindrical body portion 29 which is arranged fitting into a hole of the top support plate 23.

The top support plate 23 is attached to the bottom support plate 23 by means of the rods 30. The bottom support plate 23 is provided with a rotating shaft 31 which is attached fixedly thereto. This rotating shaft 31 is rotatable back and forth each time through 180° as according to the arrow P6.

Arranged between the support plates 23 is a second group of carriers 21 mounted pivotally therebetween in a manner similar to the first group. This second group also has a gear wheel rim 25' which is however only provided with inner toothing but which on the other hand is embodied with pins 32 protruding through the top support plate 23 which are fixed to the underside of a fork-like plate 33. The pins 32 can slide in a circular slotted hole 34 through a determined angle so that the gear wheel rim 25 can turn through this determined angle relative to the top support plate 23. A number of operations are effected by turning the fork-like member 33 by means of the arm 37 in for instance the direction of the arrow P7. To this end the fork-like member 33 is likewise provided with a circular slotted hole 36 which slides close-fittingly around the body part 29 of the fixed pinion 27.

The above described orienting station operates as follows.

Figure 4:
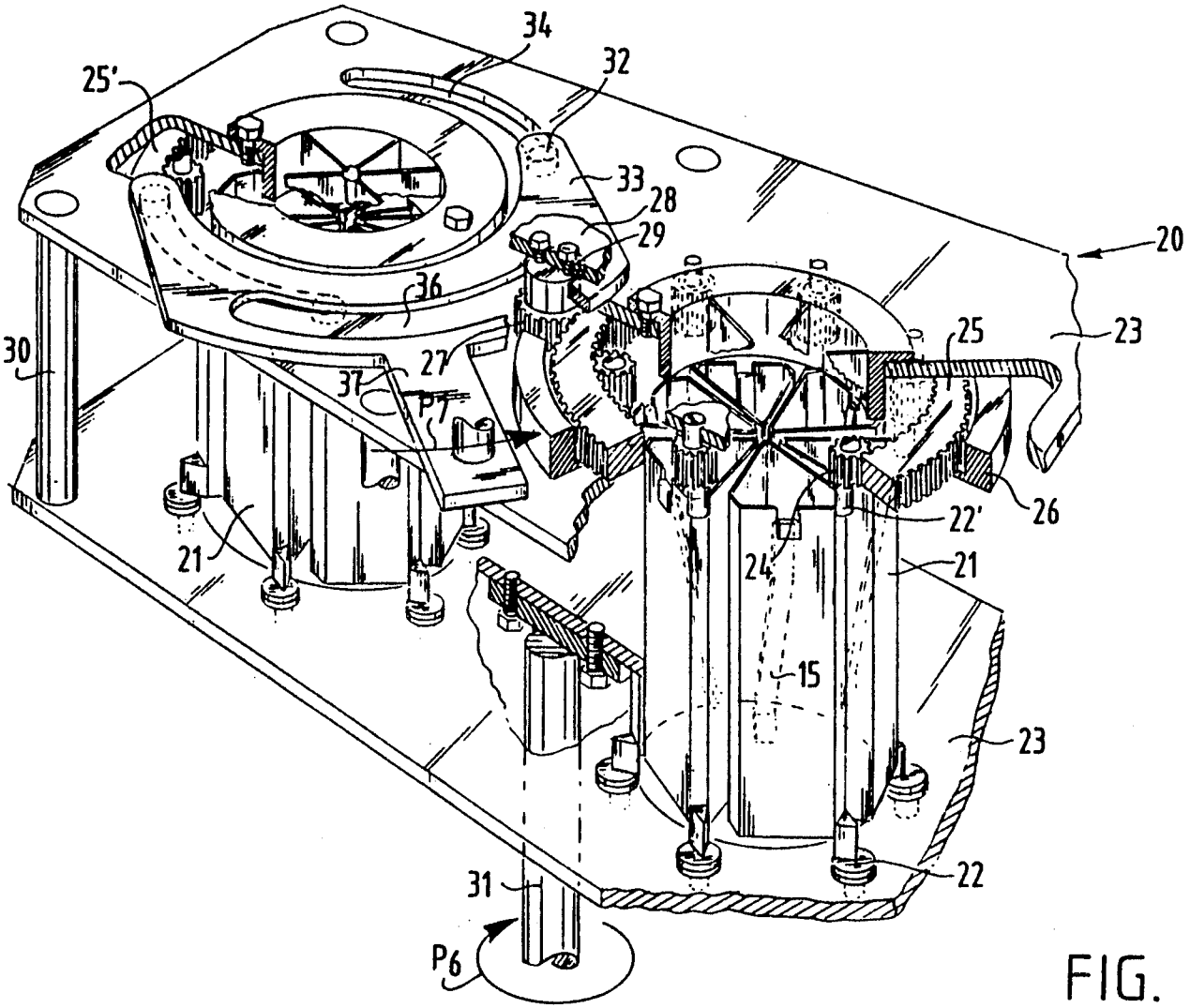
FIG. 4 shows a perspective view corresponding with FIG. 3 along arrow IV of a detail of the device of FIG. 2.

When an object V is pushed through the cutting station 10 this provides as according to FIG. 3 six portions which are each received in an individual carrier 21, wherein it is assumed that the foremost group of carriers 21 in FIG. 4 is located beneath the cutting station 10. The portions therefore enter the carrier 21 supported in similar manner by leaf springs 15, see also FIG. 5. The whole system is subsequently rotated through 180° by the shaft 31 between the support plates 23 according to arrow P6, whereby the following movements occur. The carriers 21 revolve to the outside about their axes of rotation lying along the rib and defined by the journals 22 and enter a position which was previously occupied by an adjacently positioned carrier 21, see the dashed line in FIG. 5, which movement is indicated by the arrow P7. This turning movement is brought about since the pinions 24 are rotated along the inside of the gear wheel rim 25, because the gear wheel rim 25 rolls along the fixed gear wheel 27 when the holders 23 turn through 180°.

The other group of carriers 21 herein enters the foremost position in FIG. 4, wherein their turning is provided by the sliding of the lever 37 and therefore the fork-like member 33 which carriers along the gear wheel rim 25', thus bringing the carriers 21 into the foremost position in FIG. 4.

Figure 5:
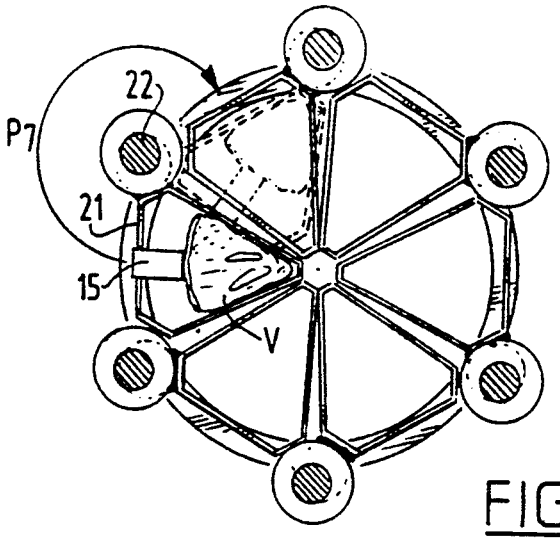
FIG. 5 is a top view of a part of the carriers in FIG. 4.

It will be apparent from the above that the portions of the object V which were positioned with their skin facing outward, have been turned in the second position, shown with dashed lines in FIG. 5, with a cut surface facing to the outside. This position serves for the insertion in the holder H, which is further elucidated hereinbelow.

The discharging of a longitudinally slit product portion out of the cylindrical carrier takes place when these carriers are situated on the left in FIG. 4, that is, the position indicated in FIG. 5 with dashed lines. Pushing out is performed by a pushing member 12' similar to and arranged behind the pushing member 12 and which is likewise fixed to the beam 13 and moves synchronously therewith.

Figure 7:
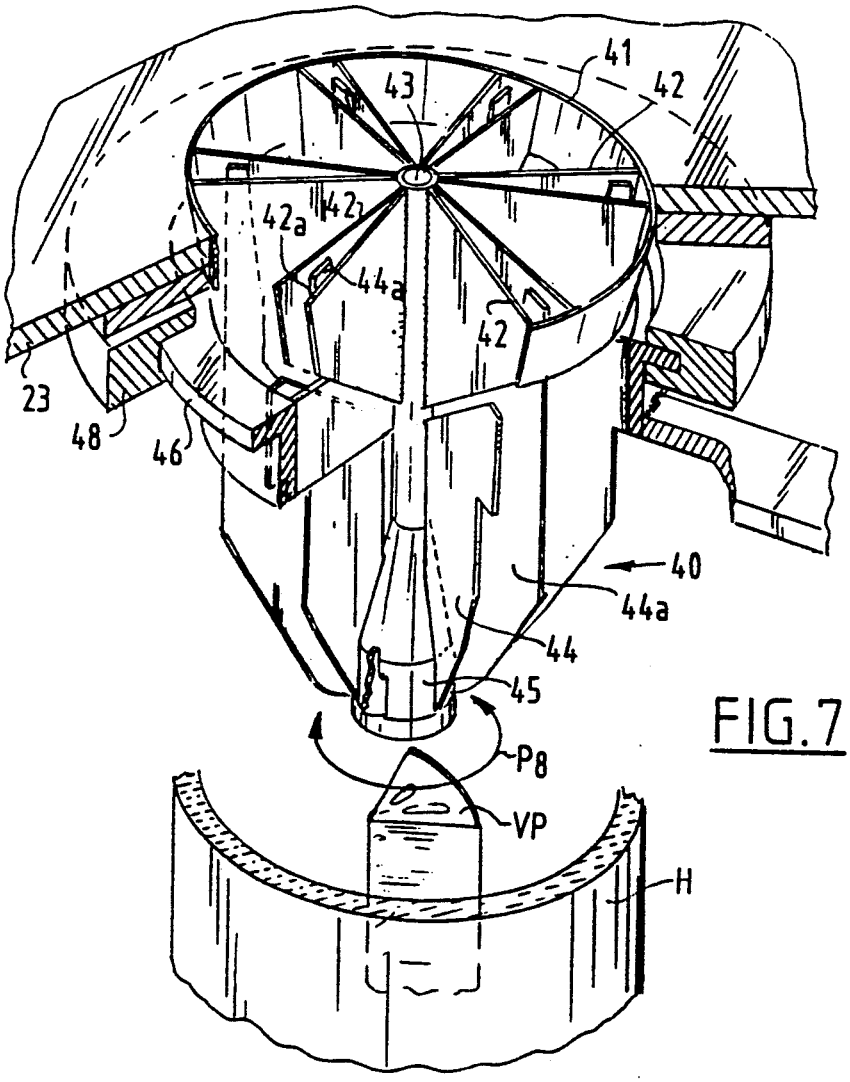
FIG. 7 is a perspective view of a detail of the device in FIG. 6 on enlarged scale, FIG. 8*a, b, c* each show a perspective view of a glass jar filled respectively with one, two and three products cut and ordered according to the invention.
Figure 6:
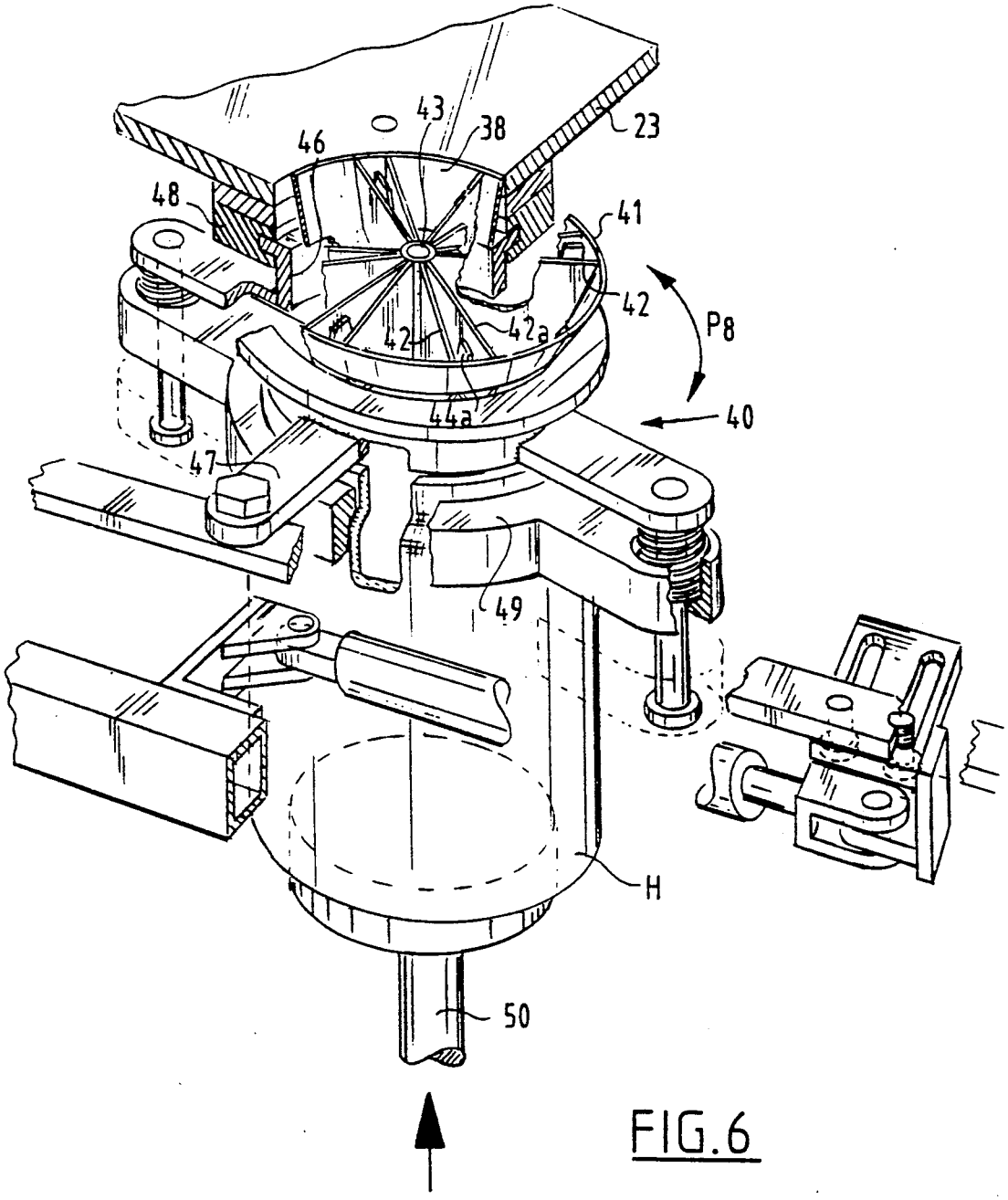
FIG. 6 shows a perspective view corresponding with FIG. 3 of a detail of the device of FIG. 2 along arrow VI.

Located on the underside of the support plate 23 in which a passage opening is arranged is a guiding and filling means 40 as in FIGS. 6 and 7. This guiding and filling means consists of an annular guide edge 41 which is provided with a number of radially extending fixed partitions 42. The fixed partitions are mutually connected at the centre by a core 43. Six fixed partitions 42 are arranged so that inside the ring 41 six compartments are formed corresponding to the number of carriers 21 which are located thereabove and with which the compartments are in register.

Arranged inside each compartment is a second partition **42*a* which is fixedly attached to the core 43 and to the guide edge 41. The portion conically thickened at 45 is rotatable in the core 43. The partitions 44 are fixedly connected to an annular part 46 and to conical portion 45 which is supported rotatably in a supporting ring 48 by means of an arm 47. Also arranged in conical portion 45 are flexible partitions 44*a* which are held fixedly against turning in the guide edge 41 by the partitions 42 and 42*a*. The supporting ring 48 is fixedly attached to the support plate 23. By turning the ring 46 relative to the spindle 43 the movable partition 44 can be moved according to arrow P8 from a position close to the one fixed partition 42***a* over the compartment to the opposite fixed partition 42 and vice versa.

Figure 8A:
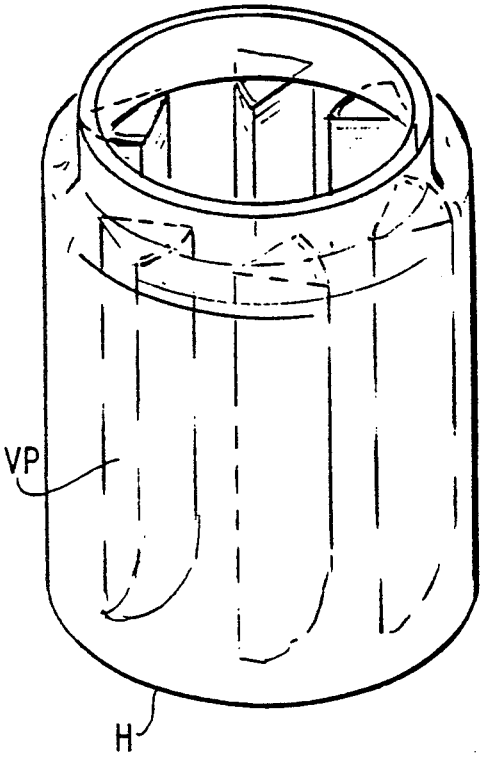
Figure 8B:
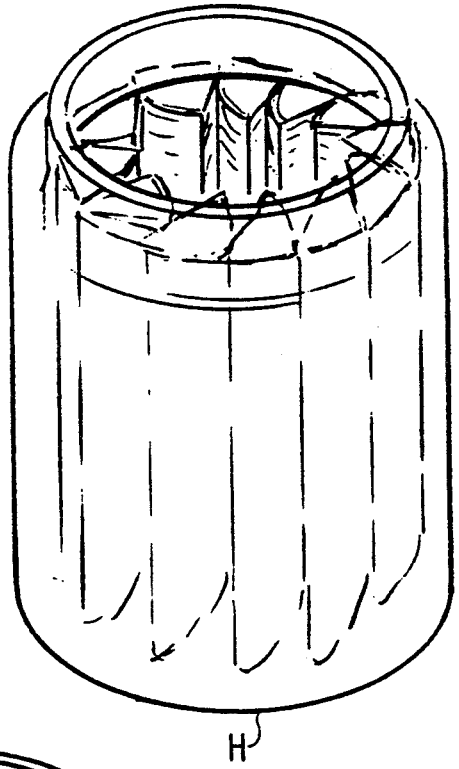

With the construction shown the six compartments at the top of the spindle 43 are therefore gradually divided towards the bottom into twelve compartments, that is, twice as many. Since the compartments are open to the outside close to the underside of the cone 45, a product can be discharged to the outside if it is pushed by a pressure element 12 out of the carriers 21 as in FIG. 5 into the compartments between the fixed partitions 42 and 42*a* and, depending on the position of the movable partition 44 and 44*a*, be discharged on the left or right hand side of the partition on the underside of the cone 45. This has the following consequence. If a product is divided into six portions in the above described manner and oriented with a cut surface facing outward by means of the cylindrical carriers 21, each product portion VP is pressed with the cut surface against the outer wall of a holder H, which is possible by pressing a holder H against the underside of a receiving ring 49 beforehand by means of an upwardly operating ram 50 arranged on the bottom of transverse conveyor 2, see also FIG. 2. The transverse conveyor 2 is provided for this purpose with a number of annular elements 51 for receiving one holder H at a time. When the conveyor 2 has carried a holder H underneath the dividing and orienting means 40 the ram 50 is energized for pressing upward the holder H against the annular support 49 so that the open top of the holder comes to lie under the ring 46. Herein the cone 45 with the partitions 44 and 44*a* connected thereto protrudes into the holder H. In this situation the longitudinal portions VP are placed evenly distributed along the periphery of the holder H as shown in FIG. 8*a*. The following product is cut into longitudinal portions and brought into the correct position as according to FIG. 5 by means of the carriers 21 and, when the movable partitions 44 and 44*a* are reversed, the portions will be arranged precisely between the previously arranged portions and likewise against the outer periphery of the holder H, see FIG. 8*b*.

Figure 8C:
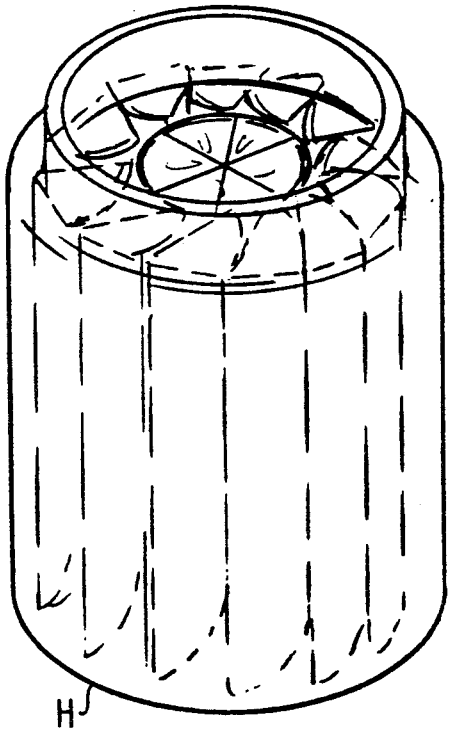

In this situation the holder H with the products can be lowered by releasing the ram 50, whereby the latter sinks back into the ring 51. The device is provided at the rear end of the transverse conveyor 2 with a second cutting station 10 which operates in the same manner as the above described first cutting station 10. Products are fed one at a time from the second endless conveyor 5 into the receivers 6 as according to arrow P4, see top left in FIG. 2, and pressure element 12" will push a product out of the receiver 6 into the cutting station 10, subsequently pushing it through into the core of the jar H that can be placed thereunder. This product is finally arranged between the longitudinal portions of the previously inserted products as shown in FIG. 8*c*.

With the embodiment shown it is therefore possible to place the cut products in a holder H in a determined pattern with the cut surfaces facing outward. If the holder is a glass jar the buyer can immediately determine the type and quality of the product.

Figure 10:
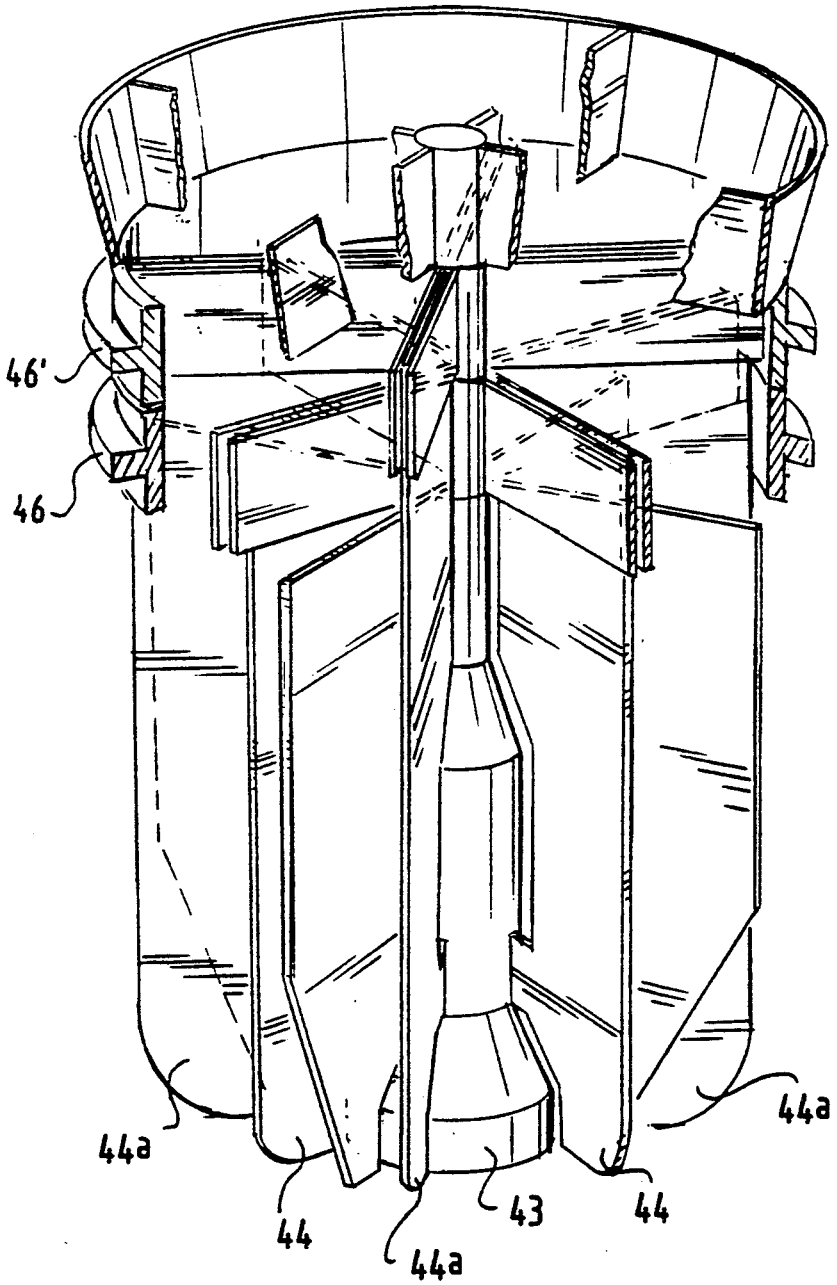
FIG. 10 is a perspective view of a part of the detail of the device in FIG. 9, FIG. 11*a, b, c* each show a top view of a position of the guiding and filling means in FIG. 9.
Figure 11A:
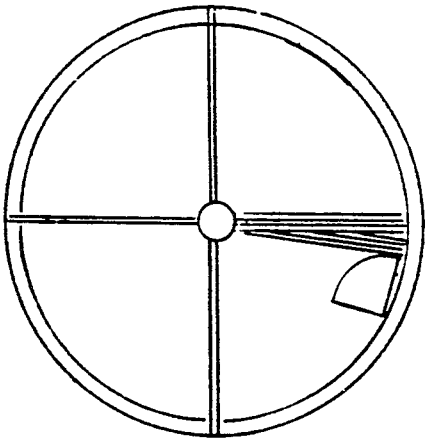
Figure 11B:
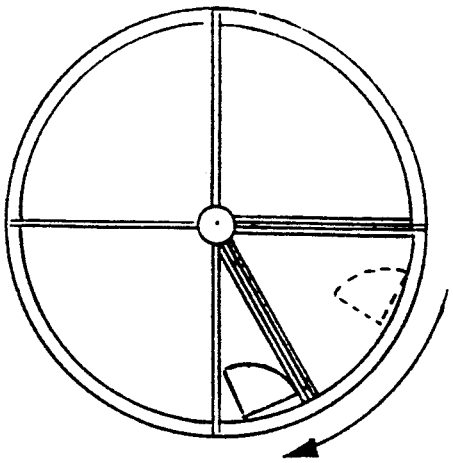
Figure 11C:
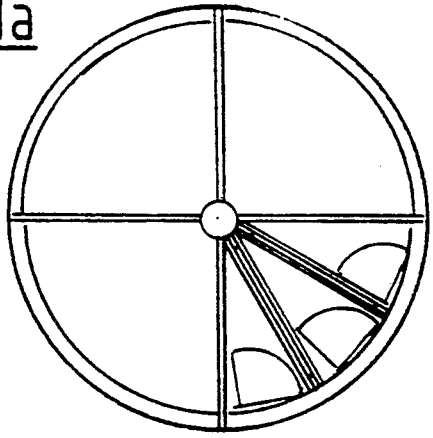

Turning now to the FIGS. 9–11, there will be described a second embodiment according to the invention, in which figures the same reference numerals will be used with respect to the same parts of the machine.

Figure 9:
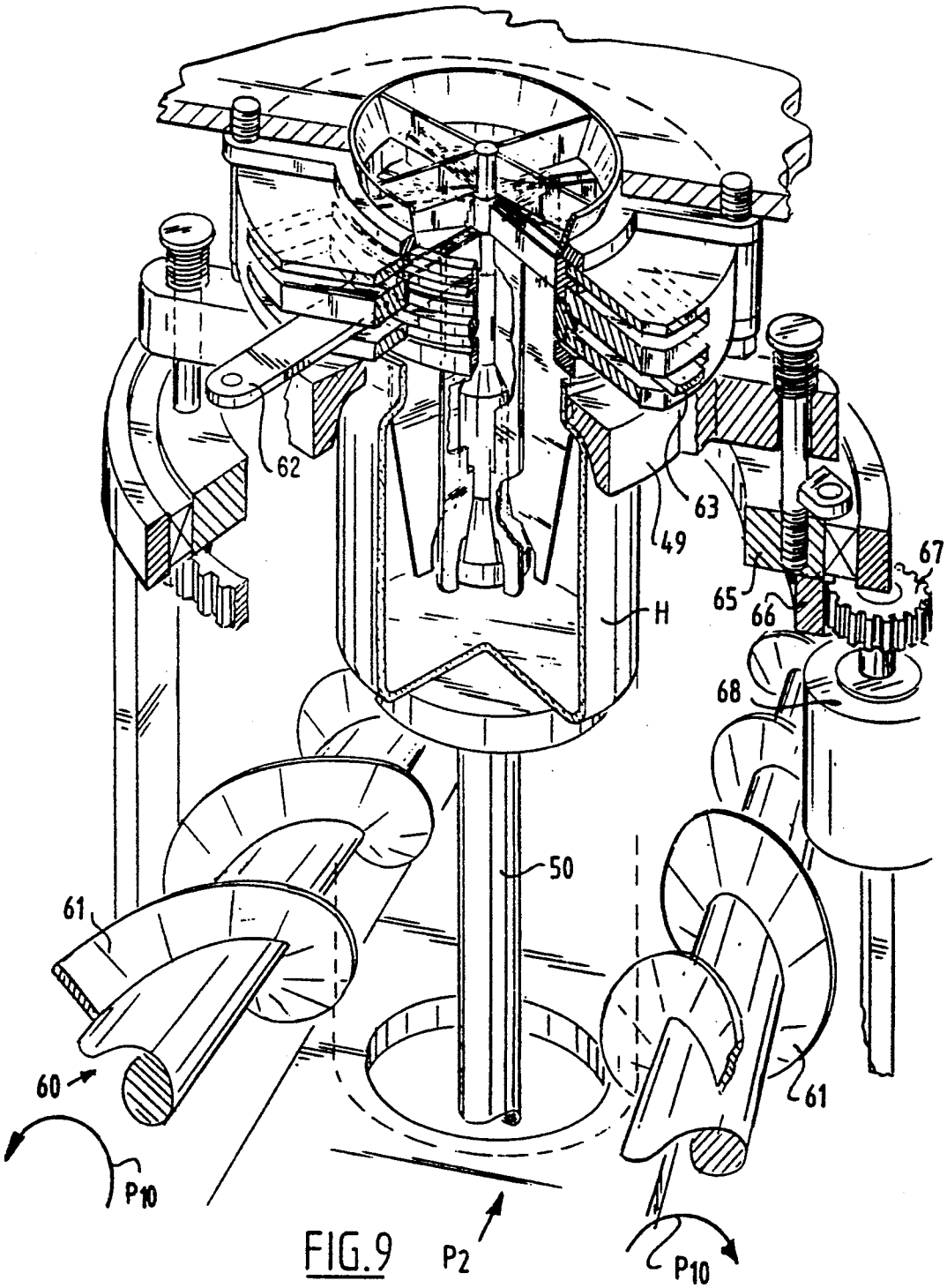
FIG. 9 is a perspective view corresponding with FIG. 7 of a second embodiment of the device according to the invention.

The holder H drawn in phantom lines in FIG. 9 is brought in place by means of a screw conveyer, consisting of two parallel screws rotating according to the arrows P10, wherein the ridges 61 are arranged such that a jar snugly fits into the intervals. So when rotating the screw conveyors 60 a jar is transported according to arrow P2 as depicted in FIG. 2, so being able to transport the jars in line along the different stations.

FIG. 9 shows the guiding and filling means, provided with two movable partition walls 44, 44*a* per section corresponding to the embodiment in FIG. 7. In order to flex those movable partitions in the right direction, two rings 46 on top of each other are movable relative to the spindle 43. Each ring 46, 46' is connected to a separate driving mechanisme by means of the arm 62, 63, so being able to flex the partition walls 44, 44*a* indepently of each other.

Figure 12:
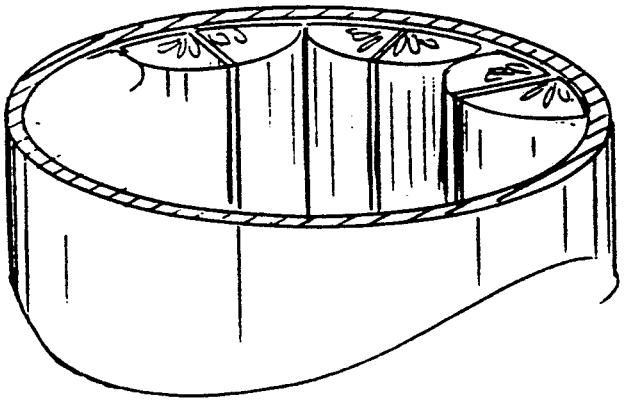
FIG. 12 is a perspective view of the top part of a jar filled partly with pieces of product according to a different pattern.

Owing to such an arrangement of the independent driving means of the partition walls the pattern of the product portions VP can be established in different ways. So one is able to bring the product portions VP into the jar according to FIG. 11*a*, *b* and *c* respectively, wherein the product portions are placed in line, so seen as a half product, whereas according to the pattern in FIG. 12, the product is seen full size when placing the product portions VP alternately placed in the jar.

Finally it is noted that the holder or jar H is pushed up by the ram 50 such that the open top of the holder will be pressed against the annular support 49. Here the annular support 49 is supported on a second annular support 65 which is rotatably guided in an outer ring 66. The annular support 65 is provided with a gear wheel 66, co-operating with a gear wheel 67, driven by a motor 68.

Owing to this rotatable supported ring 49 the jar or holder H can be rotated on the ram 50, whereby the product portions will be pressed sufficiently against the outer wall of the holder, the jars or holders will be filled better and can be pulled off the filling and guiding means more easily.

The invention is not limited to the above described embodiment. It is thus possible to divide the product into four or eight portions instead of six and likewise to otherwise arrange the disposition of the longitudinal portion in the holder H. To this end the transmission ratio of the gear wheels of the carriers 21 has to be changed so that the position of the product portions VP can be altered.

We claim:

1. Device for packing products into cylindrical holders, comprising:

at least one cutting member for cutting each product into portions, means for receiving the portions, means for transporting the holders, and means for guiding and filling the portions into the holder in a pre-determined pattern, wherein the receiving means comprises a plurality of prism-shaped carriers disposed in a circle and each receiving a portion, wherein each of said carriers is pivotable about an axis from a first position wherein the portion coming out of the cutting member is received to a second position wherein the portion is delivered to the guiding means.

2. Device as claimed in claim 1, wherein the axis of each carrier is arranged parallel to and close to a rib thereof, and wherein the axes of said carriers are disposed in the form of a circle.

3. Device as claimed in claim 1, wherein the guiding means comprises a plurality of prismatic passages corresponding to the number of carriers and which are likewise disposed in a circle, wherein a displaceable guiding member is arranged in the passages.

4. Device as claimed in claim 3, wherein the guiding member is formed by a plate which is attached to a bottom end of a spindle and coupled at a top end to an annular element rotatable relative to the plate.

5. Device as claimed in claim 2, wherein the guiding means comprises a plurality of prismatic passages corresponding to the number of carriers and which are likewise disposed in a circle, wherein a displaceable guiding member is arranged in the passages.

* * * * *